US007656268B2

(12) United States Patent
Yu

(10) Patent No.: US 7,656,268 B2
(45) Date of Patent: Feb. 2, 2010

(54) SAFETY SWITCH

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 1061 days.

(21) Appl. No.: 11/173,381

(22) Filed: Jul. 2, 2005

(65) Prior Publication Data

US 2007/0001797 A1 Jan. 4, 2007

(51) Int. Cl.
*H01H 71/16* (2006.01)
*H01H 61/00* (2006.01)
*H01H 13/00* (2006.01)

(52) U.S. Cl. ..... 337/59; 337/37; 337/52; 337/66; 200/334; 200/339

(58) Field of Classification Search ..... 337/66, 337/27, 36–37, 56, 62, 85, 113, 59, 52; 200/334, 200/520–525, 529–535, 553, 339
See application file for complete search history.

(56) References Cited

U.S. PATENT DOCUMENTS 3,932,829 A * 1/1976 Ellenberger ..... 337/49
4,167,720 A 9/1979 Krasser
4,258,349 A * 3/1981 Flory ..... 337/46
4,931,762 A * 6/1990 Fierro ..... 337/66
4,937,548 A 6/1990 Sdunek
5,223,813 A 6/1993 Cambreleng
5,262,748 A 11/1993 Tsung-Mou
5,451,729 A 9/1995 Onderka
5,491,460 A * 2/1996 Krasser et al. ..... 337/70
5,539,371 A * 7/1996 Yu ..... 337/66
5,558,211 A 9/1996 Heydner
5,933,069 A * 8/1999 Huang ..... 337/66
6,275,134 B1 * 8/2001 Chen ..... 337/37
6,452,125 B1 * 9/2002 Yu ..... 200/553
6,538,553 B2 * 3/2003 Yu ..... 337/365
6,577,221 B1 * 6/2003 Wang ..... 337/59
6,822,179 B1 * 11/2004 Huang ..... 200/401
6,884,955 B1 * 4/2005 Yu ..... 200/553
6,984,798 B1 * 1/2006 Lu ..... 200/334
6,992,559 B2 * 1/2006 Huang ..... 337/66
7,030,726 B2 * 4/2006 Yu ..... 337/66

FOREIGN PATENT DOCUMENTS

DE 19746589 A1 * 5/1999

* cited by examiner

*Primary Examiner*—Anatoly Vortman
*Assistant Examiner*—Bradley H Thomas

(57) ABSTRACT

A switch includes a body and a switch member pivotably engaged with the top opening of the body. A link has one end pivotably connected to a first end of the switch member and the other end of the link is movably received in a guide path is defined in the body. The second end of the link is located at an inner periphery of the guide path when the switch member is in "ON" position to let two contact points be in contact with each other, and a space is defined between the second end of the link and the outer periphery of the guide path so that the second end of the link is allowed to move toward the outer periphery when a contact portion is deformed upward when overloaded.

10 Claims, 8 Drawing Sheets

SAFETY SWITCH

FIELD OF THE INVENTION

The present invention relates to a safety switch that ensures the bi-metallic plate is deformed as desired when overloaded.

BACKGROUND OF THE INVENTION

A conventional switch device, especially for those switches using a bimetallic plate to prevent from being burned when an overload occurs, generally includes a bi-metallic plate which is deformed when overloaded so as to separate the two contact points respectively located on the bi-metallic plate and one of the two terminals. U.S. Pat. Nos. 5,262,748; 4,167,720; 4,937,548; 5,223,813; 5,451,729; and 5,558,211 disclose related switch devices. Some inherent shortcomings for these conventional safety switch devices are found. There are too many parts involved in the safety switch device and a longer period of time is required when assembling the switch device, this increases the cost of the products. The parts might be arranged inaccurately and affect the deformation of the bi-metallic plate. Once the bi-metallic plate is deformed to cut off the circuit, because of the improper arrangement of the parts as mentioned above, the bi-metallic plate could deform to re-connect the two contact points to connect the circuit again. Because the inaccuracy of the deformation of the bi-metallic plate, the switch member does not set the "OFF" position after the bi-metallic plate is deformed to cut off the circuit.

Therefore, it is desired to have a safety switch that allows the bi-metallic plate to deform toward a desired direction and also have enough space to prevent the bi-metallic plate from bouncing back to connect the circuit again.

SUMMARY OF THE INVENTION

In accordance with an aspect of the present invention, there is provided a switch that comprises a body with a switch member pivotably engaged with the top opening of the body and a guide path is defined in an inside of the body. A link has a first end pivotably connected to an underside of a first end of the switch member and a second end of the link is movably received in the guide path. The switch member has an extension extending from a second end of the underside thereof. A first terminal and a second terminal extend through a bottom of the body. A contact plate has a first end fixed to the first terminal and a second end of the contact plate is a free end. A contact portion splits from the contact plate and a first contact point is connected to an underside of the contact portion. A free first end of the contact portion is located above a top surface of the contact plate and connected with a free first end of a spring member. A second end of the spring member is connected to the contact plate. A second contact point is connected to the second terminal and located beneath the first contact point. The second end of the contact plate and the second end of the contact portion are deformed in opposite directions when being heated. The extension of the switch member is located above the second end of the contact plate and presses the second end of the contact plate downward when the switch member is in "OFF" position. When the second end of the switch member is pushed downward to "ON" position, the spring member is pushed by the second end of the link to contact the first contact point and the second contact point. The second end of the link is located at an inner periphery of the guide path and a space is defined between the second end of the link and an outer periphery of the guide path.

The main object of the present invention is to provide a safety switch which provides a guide path for movement of a link and the path provides a sufficient space for movement of the link when the contact plate is deformed due to overloading so that the contact plate will not deform when cooled down.

Another object of the present invention is to provide a safety switch wherein the contact portion is directly pushed by a link connected to the switch member so that the action is precisely and reliable.

Yet another object of the present invention is to provide a safety switch that includes a fewer number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
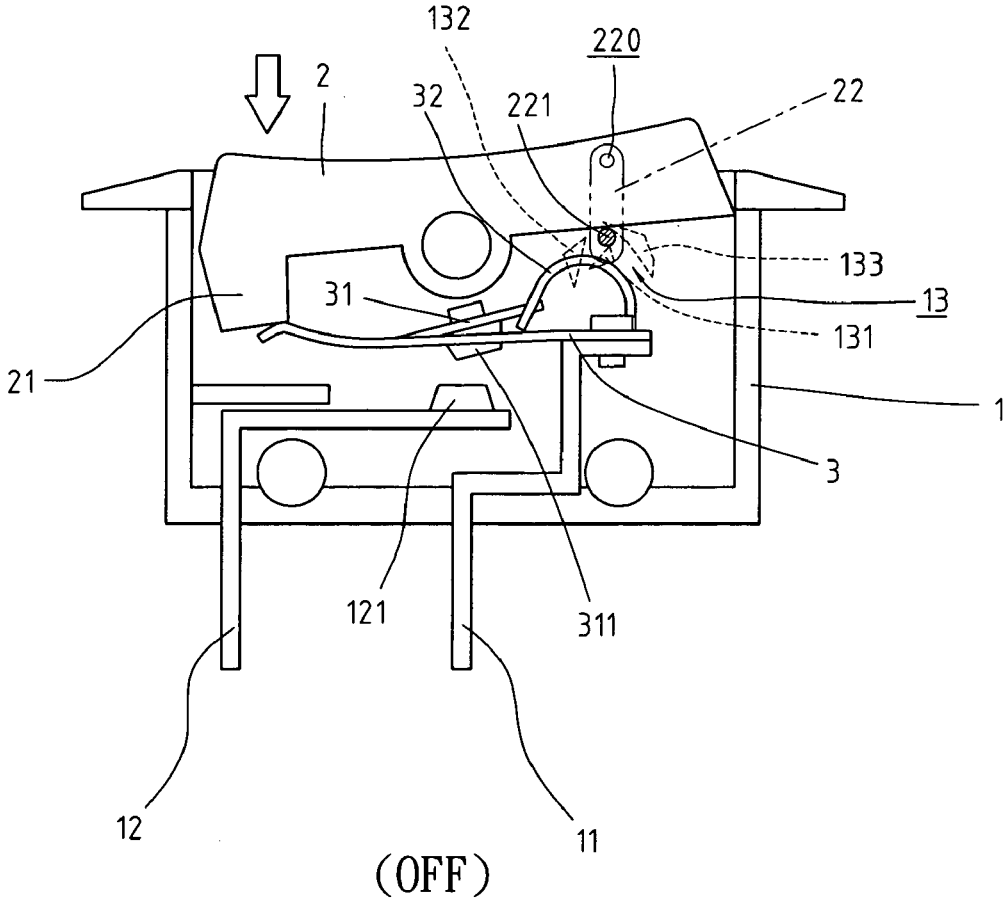
FIG. 1 is a side view to show the "OFF" status of the safety switch in accordance with the present invention.
Figure 2:
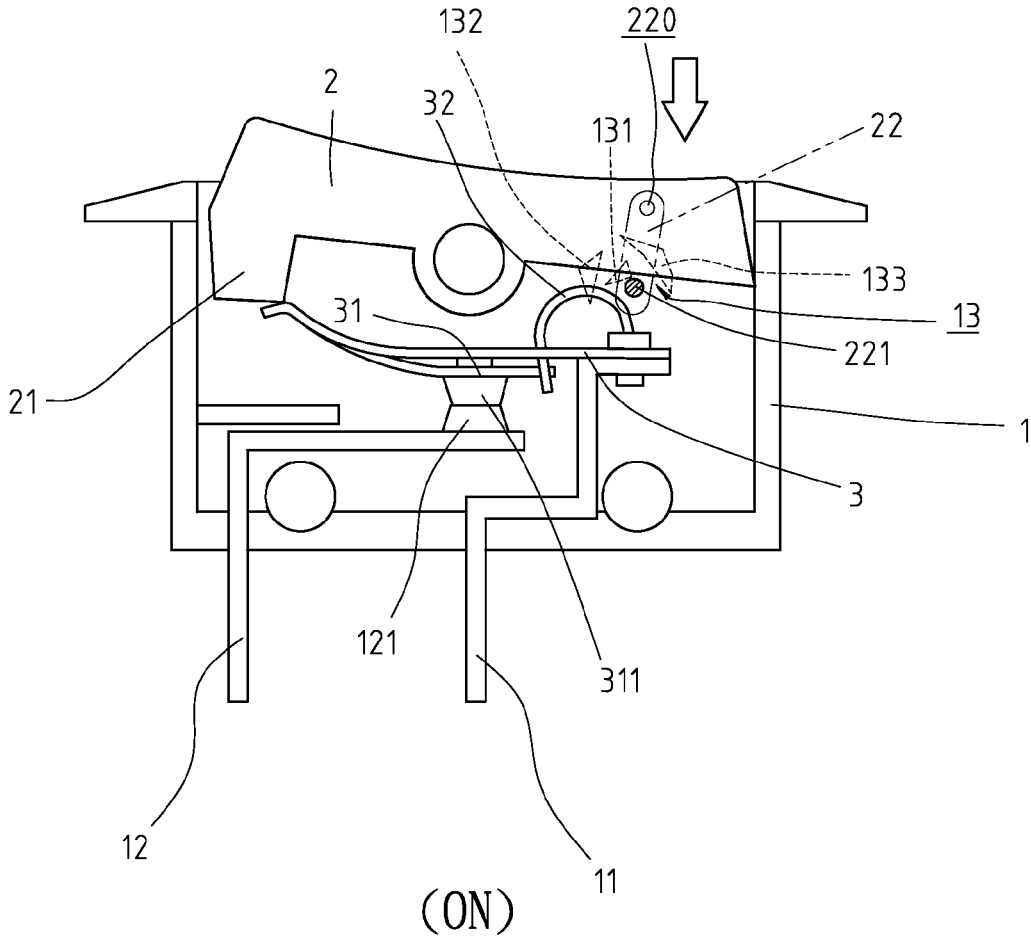
FIG. 2 is a side view to show the "ON" status of the safety switch in accordance with the present invention.
Figure 4:
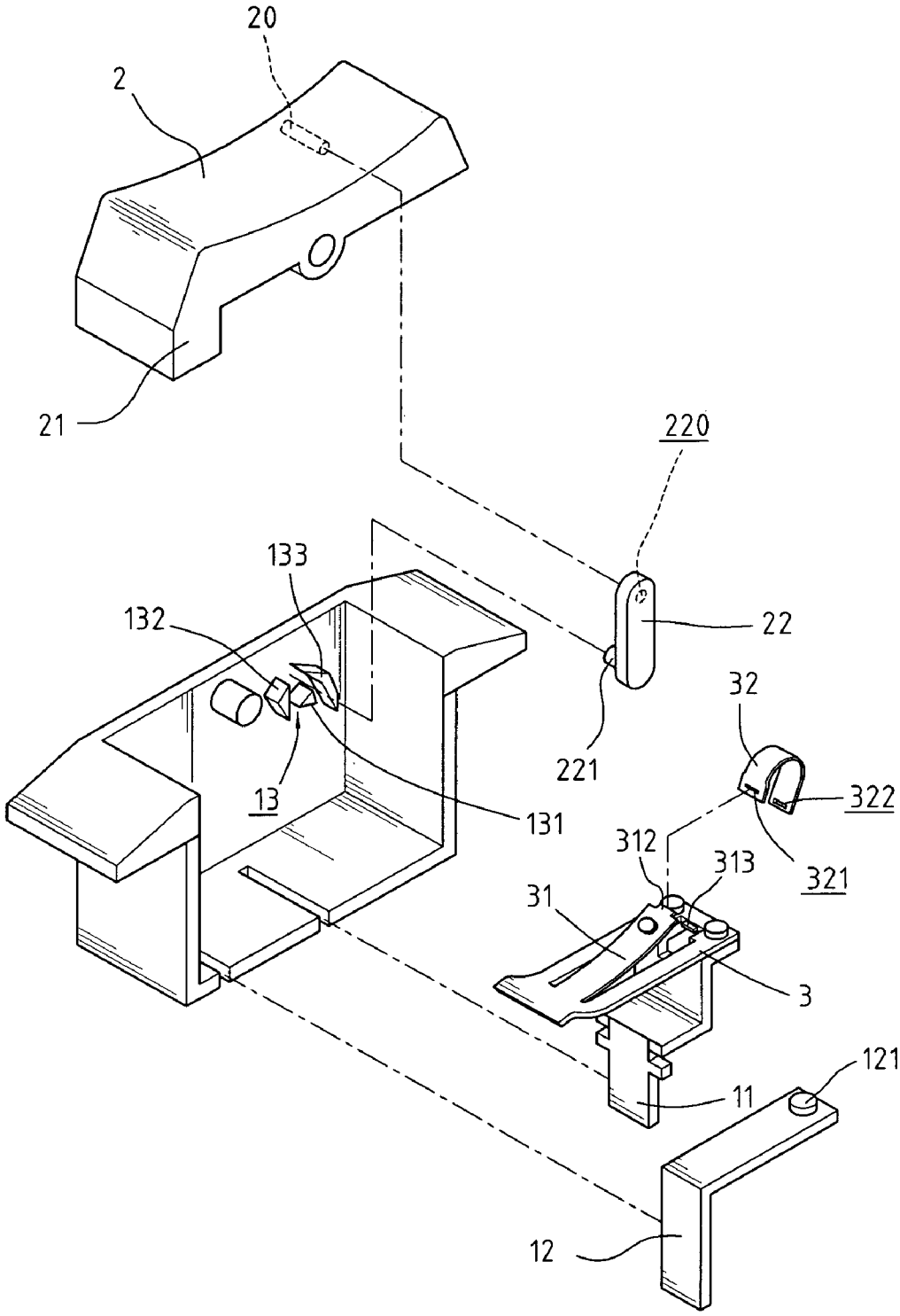
FIG. 4 is an exploded view of the safety switch in accordance with the present invention.
Figure 5:
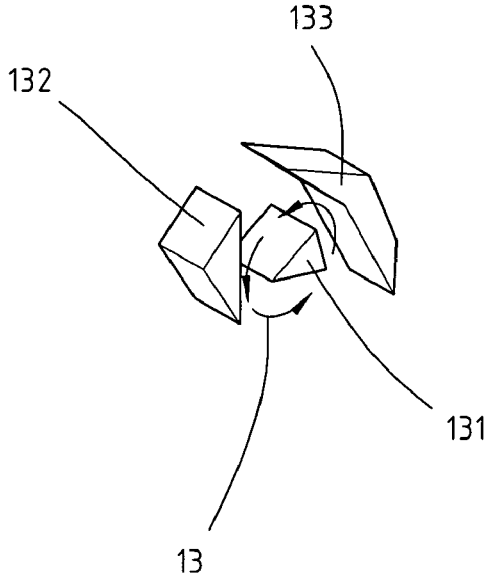
FIG. 5 shows the center piece, the right piece and the left piece to define the guide path.

Referring to the drawings and in particular FIGS. 1, 2 and 4, a safety switch constructed in accordance with the present invention comprises a body 1 with a top opening and a switch member 2 is pivotably engaged with the top opening of the body 1. A guide path 13 is defined by a plurality of separated pieces that extend from the inside of the body 1 and include a center piece 131, a left piece 132 and a right piece 133. The three pieces 131, 132, 133 are fixed on an inside of the body 1 and center piece 131 is a triangular piece so that the guide path 13 is defined between two sides of the center piece 131 and the left piece 132 and the right piece 133. A first terminal 11 and a second terminal 12 extend through a bottom of the body 1.

A link 22 has a hole 220 defined in a first end thereof and a pin 20 extends from a sidewall of a first end of the switch member 2 and the pin 20 extends through the hole 220. A second end of the link 22 has a rod 221 which is movably received in the guide path 13. The switch member 2 has an extension 21 extending from a second end of the underside thereof.

A contact plate 3 is a curve flexible bi-metallic plate and has a first end fixed to the first terminal 11 and a second end of the contact plate 3 is a free end. A contact portion 31 splits from the contact plate 3 and a first contact point 311 is connected to an underside of the contact portion 31. A free first end of the contact portion 31 is located above a top surface of the contact plate 3 and connected with a free first end of a U-shaped spring member 32. The free end of the contact portion 31 has a tongue 312 and the free first end of the spring member 32 has a first slot 321 with which the tongue 312 is engaged. The second end of the spring member 32 has a second slot 322 and a ridge 313 extends from an inner periphery of an opening from which the contact plate splits, the ridge 313 is engaged with the second slot 322. A second contact point 121 is connected to the second terminal 12 and located beneath the first contact point 311 on the contact portion 31. It is noted that the second end of the contact plate 3 and the free end of the contact portion 31 are deformed in opposite directions when being heated. The extension 21 of the switch member 2 located above the second end of the contact plate 3 and presses the second end of the contact plate 3 downward when the switch member 2 is in "OFF" position as shown in FIG. 1. The rod 221 on the second end of the link 22 is moved upward along the guide path 13 and located at an inner periphery of the guide path 13 and close to of a top of the center piece 131.

Figure 3:
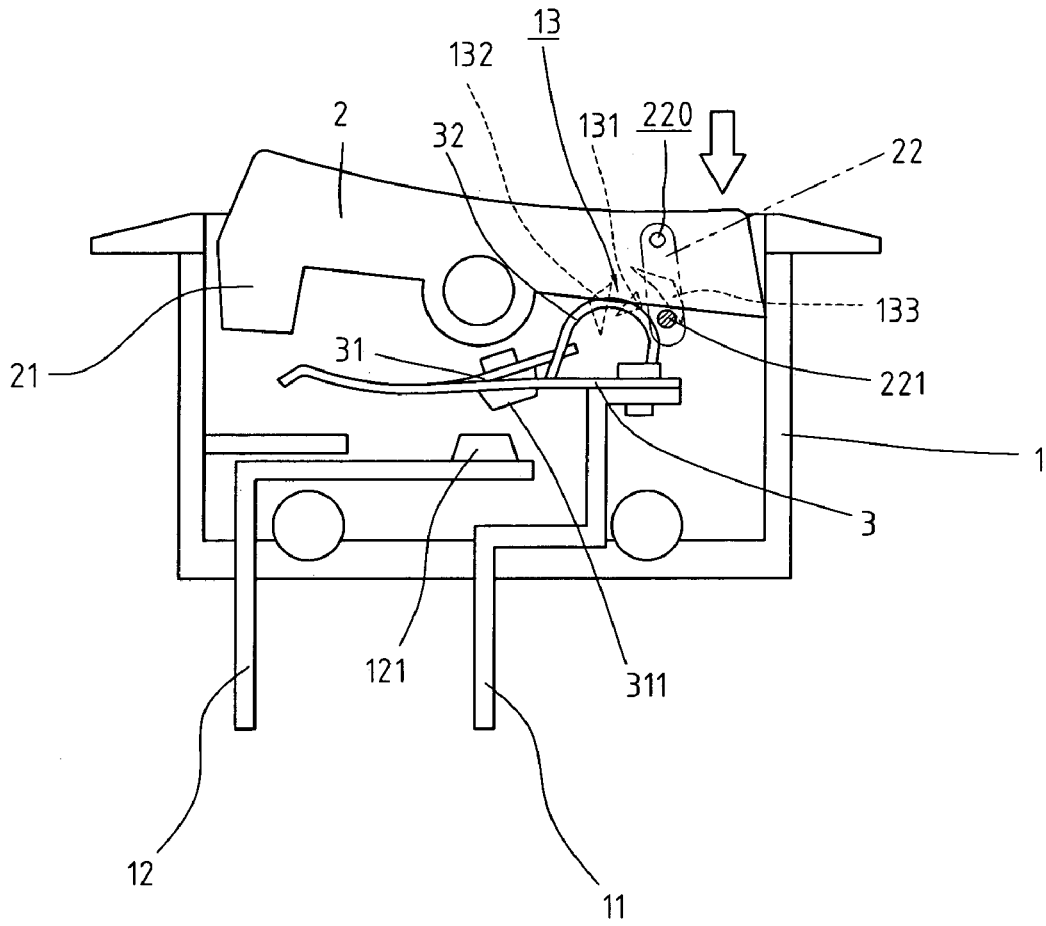
FIG. 3 shows the bi-metallic plate is deformed downward and the contact portion is deformed upward to separate the two contact points when overload.

When the second end of the switch member 2 is pushed downward to "ON" position as shown in FIG. 2, the spring member 32 is pushed by the second end of the link 22 and the first contact point 311 contacts the second contact point 121. The rod 221 on the second end of the link 22 is moved downward along the guide path 13 and located at an inner periphery of the guide path 13 and close to the right lower peak of the center piece 131. A space is defined between the second end of the link 22 and an outer periphery of the guide path 13. As shown in FIG. 3, when overloaded, the second end of the contact plate 3 is deformed downward and the first free end of the contact portion 31 is deformed upward to separate the two contact points 311 and 121. Due to the sufficient space, the spring member 32 moves right and the second end of the link 22 moves right in the guide path 13 so allow the contact plate 3 to be deformed completely.

Figure 6:
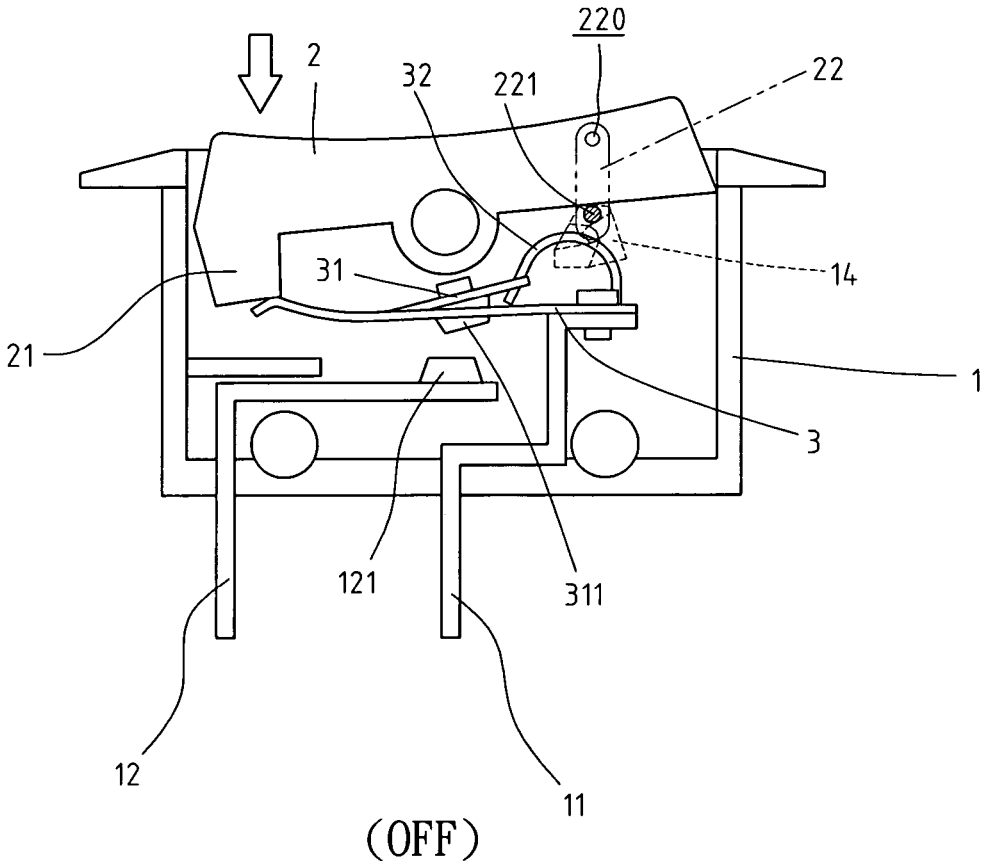
FIG. 6 is a side view to show the "OFF" status of another embodiment of the safety switch in accordance with the present invention.
Figure 7:
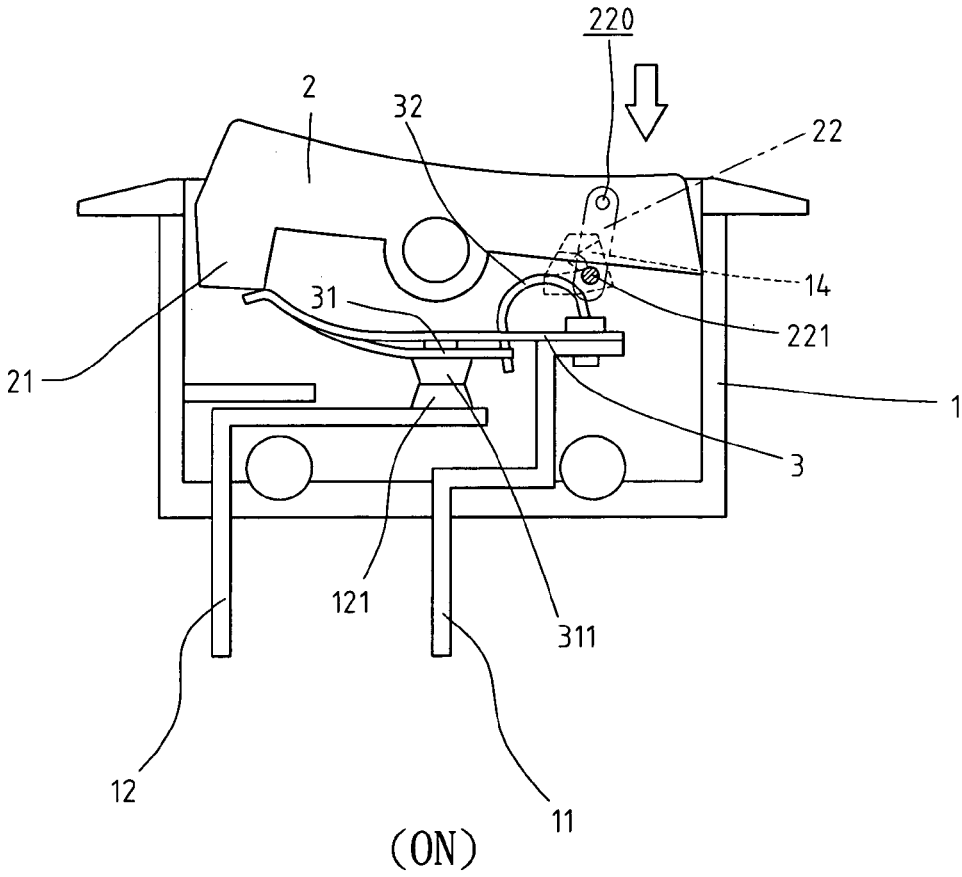
FIG. 7 is a side view to show the "ON" status of the safety switch in FIG. 6 in accordance with the present invention.
Figure 8:
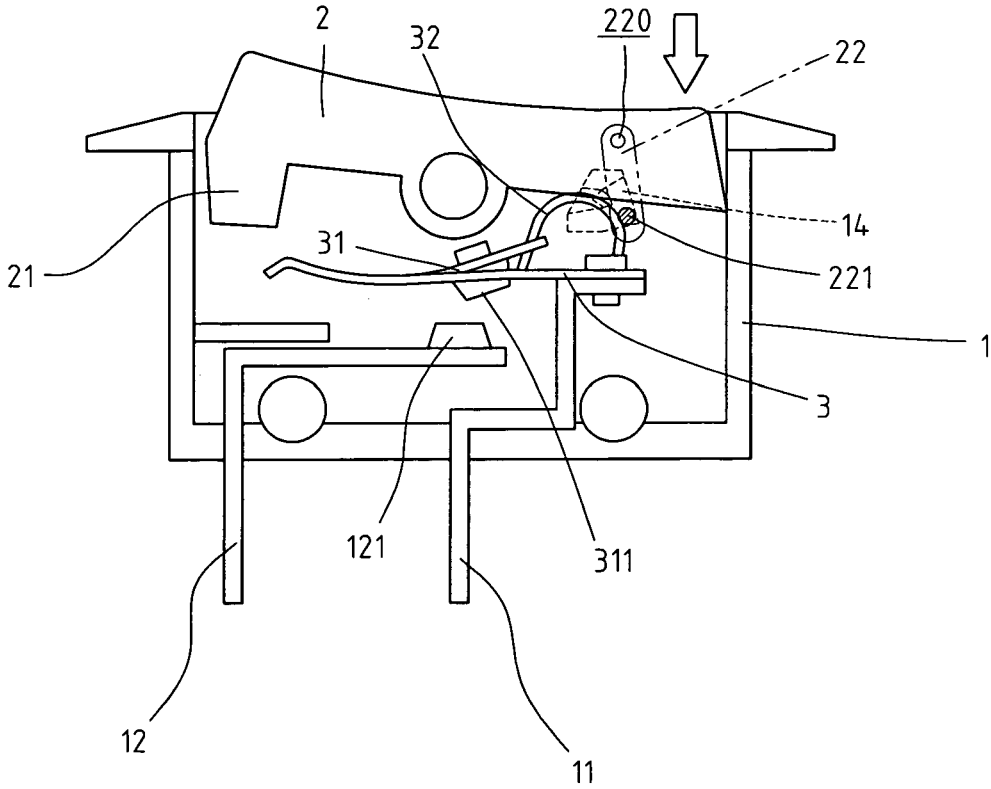
FIG. 8 shows the bi-metallic plate is deformed downward and the contact portion is deformed upward to separate the two contact points when overload of the embodiment in FIG. 6.

FIGS. 6 to 8 show another embodiment of the safety switch, wherein the only difference from the switch in FIGS. 1-7 is that the guide path 14 is a concavity or a groove defined in the inside of the body 1 and is in a form of a triangle path. The rod 221 on the second end of the link 22 is moveably received in the guide path 14 and performs the same function as described hereinbefore.

While we have shown and described the embodiment in accordance with the present invention, it should be clear to those skilled in the art that further embodiments may be made without departing from the scope of the present invention.

What is claimed is:

1. A switch comprising:

a body with a top opening and a switch member pivotably engaged with the top opening of the body, a guide path defined in an inside of the body, a first terminal and a second terminal extending through a bottom of the body;

a link having a first end pivotably connected to an underside of a first end of the switch member and a second end of the link movably received in the guide path, the switch member having an extension extending from a second end of the underside thereof;

a contact plate being a curve flexible metal plate and having a first end fixed to the first terminal and a second end of the contact plate being a free end, a contact portion split from the contact plate and a first contact point connected to an underside of the contact portion, a free first end of the contact portion located above a top surface of the contact plate and connected with a free first end of a spring member, a second end of the spring member connected to the contact plate, a second contact point connected to the second terminal and located beneath the first contact point on the contact portion, the second end of the contact plate and the second end of the contact portion being deformed in opposite directions when being heated, the extension of the switch member located above the second end of the contact plate and pressing the second end of the contact plate downward when the switch member is in "OFF" position, when the second end of the switch member being pushed downward to "ON" position, the spring member being pushed by the second end of the link to lower the first contact point to be in contact with the second contact point, the second end of the link located at an inner periphery of the guide path and a space defined between the second end of the link and an outer periphery of the guide path.

2. The switch as claimed in claim 1, wherein the guide path is defined between a plurality of separated pieces extending from the inside of the body.

3. The switch as claimed in claim 2, wherein the guide path is defined between a center piece, a left piece and a right piece, the center piece is a triangular piece.

4. The switch as claimed in claim 1, wherein the free end of the contact portion has a tongue and the free first end of the spring member has a first slot with which the tongue is engaged.

5. The switch as claimed in claim 1, wherein the second end of the spring member has a second slot and a ridge extends from an inner periphery of an opening from which the contact plate splits, the ridge is engaged with the second slot.

6. The switch as claimed in claim 1, wherein the spring member is a U-shaped member.

7. The switch as claimed in claim 1, wherein the contact plate is a bi-metallic plate.

8. The switch as claimed in claim 1, wherein the guide path is a concavity defined in the inside of the body.

9. The switch as claimed in claim 1, wherein the second end of the link has a rod which is movably received in the guide path.

10. The switch as claimed in claim 1, wherein a pin extends from a sidewall of the switch member and the first end of the link has a hole through which the pin extends.

* * * * *